US012404069B2

(12) United States Patent
Limousin et al.

(10) Patent No.: US 12,404,069 B2
(45) Date of Patent: Sep. 2, 2025

(54) FOLDING PACKAGE HAVING A SECURE FLAT CONFIGURATION

(71) Applicant: PA.COTTE SA, Pully (CH)

(72) Inventors: Damien Limousin, Saint Etienne de Montluc (FR); Simon Guilloux, Sainte Luce sur Loire (FR)

(73) Assignee: PA.COTTE SA, Pully (CH)

( * ) Notice: Subject to any disclaimer, the term of this patent is extended or adjusted under 35 U.S.C. 154(b) by 95 days.

(21) Appl. No.: 18/269,880

(22) PCT Filed: Dec. 22, 2021

(86) PCT No.: PCT/EP2021/087340

§ 371 (c)(1),
(2) Date: Jun. 27, 2023

(87) PCT Pub. No.: WO2022/144279

PCT Pub. Date: Jul. 7, 2022

(65) Prior Publication Data

US 2024/0059451 A1 Feb. 22, 2024

(30) Foreign Application Priority Data

Dec. 30, 2020 (FR) ..... 2014231

(51) Int. Cl.
*B65D 6/18* (2006.01)
*B65D 43/16* (2006.01)

(52) U.S. Cl.
CPC ..... *B65D 11/1833* (2013.01); *B65D 43/164* (2013.01); *B65D 2543/00194* (2013.01)

(58) Field of Classification Search
CPC ..... B65D 11/1833; B65D 19/12; B65D 2501/24184
See application file for complete search history.

(56) References Cited

U.S. PATENT DOCUMENTS 1,230,831 A * 6/1917 Ickes ..... B65D 11/1833 220/7
5,076,457 A * 12/1991 Marovskis ..... B65D 11/1833 220/6

(Continued)

FOREIGN PATENT DOCUMENTS

FR 2351865 12/1977
WO 2015/198504 12/2015

(Continued)

OTHER PUBLICATIONS

International Search Report and Written Opinion as issued by the International Searching Authority, dated Apr. 7, 2022, for International Patent Application No. PCT/EP2021/087340; 16 pages.

(Continued)

*Primary Examiner* — Mollie Impink
(74) *Attorney, Agent, or Firm* — Faegre Drinker Biddle & Reath LLP

(57) ABSTRACT

The invention relates to a package including a bottom and panels including a lid, the package being foldable between a use configuration defining a stowage volume, and in which the lid is capable of sealing the stowage volume; a flat configuration; the package including, in the flat configuration of the package, anchors between the bottom and at least one of the panels in a position folded down against the bottom, each anchor exerting a force for holding one of the panels in its position folded down against the bottom.

8 Claims, 6 Drawing Sheets

(56) References Cited

U.S. PATENT DOCUMENTS

| | | | | |
|---|---|---|---|---|
| 8,651,309 | B2 * | 2/2014 | Gualersi | B65D 11/1833 220/613 |
| 2009/0159593 | A1 * | 6/2009 | Apps | B65D 11/1833 220/6 |

FOREIGN PATENT DOCUMENTS

| | | |
|---|---|---|
| WO | 2020/104339 | 5/2020 |
| WO | 2021/004907 | 1/2021 |

OTHER PUBLICATIONS

English translation of International Search Report as issued by the International Searching Authority, dated Apr. 7, 2022, for International Patent Application No. PCT/EP2021/087340; 2 pages.
International Preliminary Report on Patentability as issued by the International Searching Authority, dated Jul. 4, 2023, for International Patent Application No. PCT/EP2021/087340; 11 pages.

* cited by examiner

FOLDING PACKAGE HAVING A SECURE FLAT CONFIGURATION

CROSS-REFERENCE TO RELATED APPLICATIONS

The present application is a national stage entry of International (PCT) Patent Application Number PCT/EP2021/087340, filed Dec. 22, 2021, which claims priority to French Patent Application Number 2014231, filed Dec. 30, 2020, the complete disclosures of which are expressly incorporated herein by reference.

The field of the invention is that of logistics. More specifically, the invention relates to a package, also called packing means, that is to say a container, for conveying objects between two destinations.

To transport an object safely, packages such as boxes made of plastic materials and cardboards are known.

In general, the packages comprise a case having a bottom and a peripheral rim which together define a stowage volume in which at least one object to be transported is housed.

The packages also comprise a lid that is movable relative to the case, or added onto the case, this lid being in particular able to adopt a closed position of the stowage volume in which the lid seals the stowage volume of the case.

These packages are conventionally foldable. They are thus movable between a use configuration in which the case is formed and defines the stowage volume, and a flat configuration in which the package is collapsed on itself, and produces a smaller bulk.

More particularly, the peripheral rim comprises:

- a first panel;
- a second panel;
- a third panel opposite to the first panel;
- a fourth panel opposite to the second panel.

Each panel can thus adopt:

- a stowed position in which it extends substantially parallel to the bottom;
- a use position in which it extends substantially perpendicularly to the bottom.

Prior to transporting an object, a user grabs a package in the flat configuration in order to shape it. Indeed, most often, in the storage situation of the package, the panels of the peripheral rim are in their stowed position, which implies that the package is in the flat configuration.

The user must then shape the case, that is to say define the stowage volume by positioning each of the panels of the peripheral rim in its use position.

The user can then insert an object into the stowage volume and position the lid in the closed position of the stowage volume.

Usually, the packages are made of cardboard. These cardboard packages are generally only used for a single shipment or for a particularly limited number of shipments.

These cardboard packages tend to degrade particularly quickly depending on the conditions for handling these packages, as well as on the environmental conditions to which they may be subjected.

Consequently, given the cardboard volumes used during logistical transports, it can be considered that the use of these cardboards is not ecological and particularly resource-intensive, even by taking into account the simple and easy-to-produce nature of this type of package.

Lately, reusable package projects have emerged.

These reusable packages have the ability to be used many times before having to be recycled or repaired. To this end, these packages include walls formed of materials that are more resistant and more durable than cardboard.

In the end, although it has a more complex and more expensive design or manufacture than that of cardboard packages, the ecological footprint of such reusable packages is better.

However, the use of reusable packages raises some problems.

Indeed, the problem relating to the storage of the packages already used, that is to say received by a recipient, and to be stored before being reused or resent, is present.

In fact, when a user receives a package, he is not always able to directly resend or reuse this package, and must put it aside. However, in its use configuration, a cardboard package presents a significant bulk.

Consequently, solutions aiming reduce this bulk are necessary.

Generally, a package can be brought back into its flat configuration. However, practice has shown that the bulk of a package in its flat configuration and which has already been used, that is to say which has already been shaped at least once, is often greater than the one it presented in its flat configuration prior to its first use.

It is for example observed that a package that has already been used and put back into its flat configuration may tend to redeploy, even slightly, then presenting a configuration in which it occupies a greater volume than that in its flat configuration. Of course, these packages can be kept flattened in a forced manner, but this effect can always remain in the absence of external stress.

The invention aims in particular to overcome the drawbacks of the prior art.

More specifically, the invention aims to propose a reusable package that has a limited bulk when it is desired to store it unused, and that maintains its limited bulk.

Aims of the invention are achieved by the package according to claim 1.

Herein, a package is described comprising a bottom extending between a front end and a rear end along a first axis,

- the package also comprising panels including:
  - a front panel pivotally mounted on the front end of the bottom;
  - a rear panel pivotally mounted on the rear end of the bottom;
  - side panels pivotally mounted on the bottom;
  - a lid pivotally mounted on one of the front panel or of the rear panel;
- the package being foldable between:
  - a use configuration in which the bottom, the front panel, the rear panel and the side panels form a case defining a stowage volume, and in which the lid is capable of sealing the stowage volume;
  - a flat configuration, in which the panels extend substantially parallel to the bottom;
- with, in the flat configuration of the package:
  - the side panels are in a position folded down against the bottom;
  - one of the front panel and of the rear panel is in a position folded down against the bottom overlapping the side panels, and the other of the front panel and of the rear panel is in a pivoted position in the extension of the bottom;
  - the lid is in a position folded down against the bottom, overlapping the side panels.

The package comprises, in the flat configuration of the package, anchors between the bottom and at least one of the panels in a position folded down against the bottom, each anchor exerting a force for holding one of the panels in its position folded down against the bottom, the anchors comprising:

at least a first anchor in the vicinity of the front end of the bottom;

at least a second anchor in the vicinity of the rear end of the bottom;

the first anchor(s) being spaced from the second anchor(s) along the first axis.

Thus, in its flat configuration, the package has a limited bulk.

Indeed, thanks to the principle of the invention, the package in its flat configuration maintains its shape and its bulk, and the package is prevented, in the absence of a voluntary action, from deforming, in particular by a "shape memory" effect.

More specifically, a reusable package which can thus be folded between a use configuration and a flat configuration, is likely not to be capable of naturally maintaining a flat configuration because of pivot connections between some of these elements, and of the nature of the materials forming the panels of the package.

The package according to the invention has a pivot connection between its front panel and its bottom, as well as between its rear panel and its bottom. Also, the lid is pivotally mounted on the front panel or on the rear panel. These three pivot connections are then likely to tend to open, and not to maintain the angle that they are supposed to maintain in the flat configuration of the package.

Thanks to the invention, the first anchor which is located in the vicinity of the front end of the bottom (and thus the pivot connection between the front panel and the bottom), as well as the second anchor which is located in the vicinity of the rear end of the bottom (and thus the pivot connection between the bottom and the rear panel), participate in keeping the panels and the bottom of the package substantially parallel, and thus ensure that these elements of the package keep this position when the package has been switched into its flat configuration.

For example, in the case where the rear panel extends in the extension of the bottom and where the pivot connection between the rear panel and the bottom has an elastic effect tending to raise the rear panel, then the second anchor makes it possible, by pressing two of the elements of the package located in the vicinity of the rear end of the bottom against each other, to compensate for the elastic force produced by the pivot connection. This prevents the package from losing its flat configuration.

According to one advantageous solution, the bottom comprises two side ends on which the side panels are pivotally mounted, and in that the package comprises:

two first anchors distributed respectively in the vicinity of each side end of the bottom, at the same length along the first axis;

two second anchors distributed respectively in the vicinity of each side end of the bottom, at the same length along the first axis.

Thanks to these four anchors, maintaining the package in its flat configuration is optimized. Indeed, the anchors are then distributed at different points of the package and the forces to keep the package flat are distributed over each of these four points, and this in particular as close as possible to the different pivot connections of the panels with the bottom.

According to one advantageous solution, the lid is pivotally mounted on the rear panel, one of the lid or of the front panel having:

a first part of the or each first anchor, the bottom having a second part of the or each first anchor complementary to the first part(s);

a member for holding by overlapping the other of the lid or of the front panel;

and, in the flat configuration of the package, the holding member blocks said other of the lid or of the front panel in its position folded down against the bottom.

In this way, the first anchor(s) make it possible to keep one of the lid or of the front panel pressed in a position folded down against the bottom, while the other of the front panel or of the lid is kept pressed in a position folded down against the bottom through the overlapping holding member.

Maintaining the package in its flat configuration is thus optimized.

According to one preferred design, the first anchor(s) and/or the second anchor(s) are of the type operable by clipping, a switching of the package into its flat configuration being likely to cause the clipping of the anchors.

Thanks to such a type of anchor, maintaining the package in its flat configuration is particularly simple to implement because it is simply sufficient to switch the package from its use configuration to its flat configuration to trigger each of the anchors of the type operable by clipping.

According to one preferred design, the package comprises a locking mechanism including at least one movable actuator between:

a locked position in which, in the flat configuration of the package, the first anchor(s), and/or the second anchor(s), called lockable anchor(s), are locked, and an unlocked position in which the lockable anchor(s) are inoperative.

In this way, a user of the package must actuate the actuator in order to be able to make the package leave its flat configuration and fold it in its use configuration.

The switching of the package from its flat configuration to its use configuration thus results from a voluntary action of its user.

Advantageously, the locking mechanism comprises means for elastically returning the actuator(s) tending to bring them back from their unlocked position to their locked position.

Thus, an accidental actuation of the actuator is compensated by the elastic return means which allow the actuator to be brought back to its locked position.

In addition, in combination, where appropriate, with an anchor of the type operable by clipping, then the lockable anchor presents a simple and intuitive operation. Indeed, the fact of switching the package into its flat configuration causes the clipping of the anchor with an actuator in a locked position and elastic return means tending to maintain the actuator in its locked position. In this case, only intentional actuation of the actuator and adequate handling exerted on the package make it possible to switch it into its use configuration.

According to one preferred design, only some of the first anchors or of the second anchors are lockable anchors, the others of the first anchors or of the second anchors can be unclipped by force.

This design simplifies the integration of the different functions on the anchors.

According to another preferred design, only some of the first anchors or of the second anchors are lockable anchors, the others of the first anchors or of the second anchors being detachable by means of a pivoting of the panel located in a position folded down in the extension of the bottom beyond this position folded down in the extension of the bottom.

In this way, the detachment of the anchors which are not "lockable anchors" is carried out by means of a particular kinematics of deployment of the package from its flat configuration, after having unlocked the lockable anchors.

This design also offers the advantage of securing the package in its flat configuration. Indeed, a person cannot then partially open the package, by moving apart sections of the package, without having previously unlocked the lockable anchors.

In a situation where the flat configuration of the package makes it possible to obtain a small storage volume, then this design making it possible to secure the package in its flat configuration is particularly advantageous.

Other characteristics and advantages of the invention will appear more clearly upon reading the following description of one preferred embodiment of the invention, given by way of illustrative and non-limiting example, and the appended drawings, among which:

Figure 1:
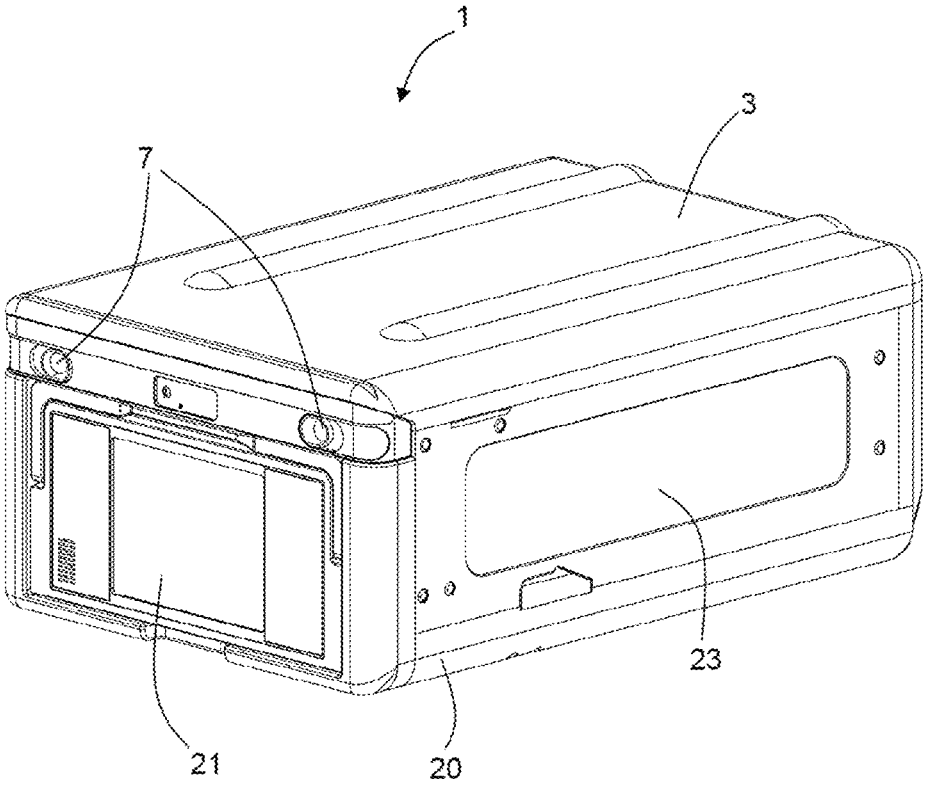
FIG. 1 is a schematic perspective top representation of a package according to the invention, in a use configuration in which a case of the package is formed and defines a stowage volume closed by a lid.

With reference to FIGS. 1, 2, 3, 4 and 6, a package 1 according to the invention is represented. The package 1 according to the invention is a foldable package. The package 1 comprises:

a bottom 20;

panels.

The bottom 20 extends between a front end 201 and a rear end 202 along a first axis 200.

The bottom 20 also comprises two side ends 203 extending between the front end 201 and the rear end 202.

The panels 21, 22, 23, 3 of the package 1 are made up of:

a front panel 21;

a rear panel 22;

side panels 23;

a lid 3.

The front panel 21 is pivotally mounted on the front end 201 of the bottom 20.

The rear panel 22 is pivotally mounted on the rear end 202 of the bottom 20.

The side panels 23 are pivotally mounted on the side ends 203 of the bottom 20.

According to the present embodiment, the lid 3 is pivotally mounted on the rear panel 22. However, according to one possible embodiment, and through an ad hoc modification of the elements described below, the lid 3 can be pivotally mounted on the front panel 21 of the package 1.

As mentioned above, the package 1 is foldable. More specifically, the package 1 can have different configurations, including a use configuration and a flat configuration.

In its use configuration, the package 1 has a case 2 defining a stowage volume.

This case 2 is formed by joining the bottom 20, the front panel 21, the rear panel 22 and the side panels 23.

In this use configuration, the front panel 21, the rear panel 22, and the side panels 23 form a peripheral rim at the bottom 20. The front panel 21, the rear panel 22, and the side panels 23 are then each in a use position.

In this use configuration illustrated in FIG. 1, the lid 3 makes it possible to seal the stowage volume.

As explained previously, the lid 3 is pivotally mounted on the rear panel 22. By pivoting the lid 3 backwards, it is possible to access the interior of the stowage volume.

Figure 2:
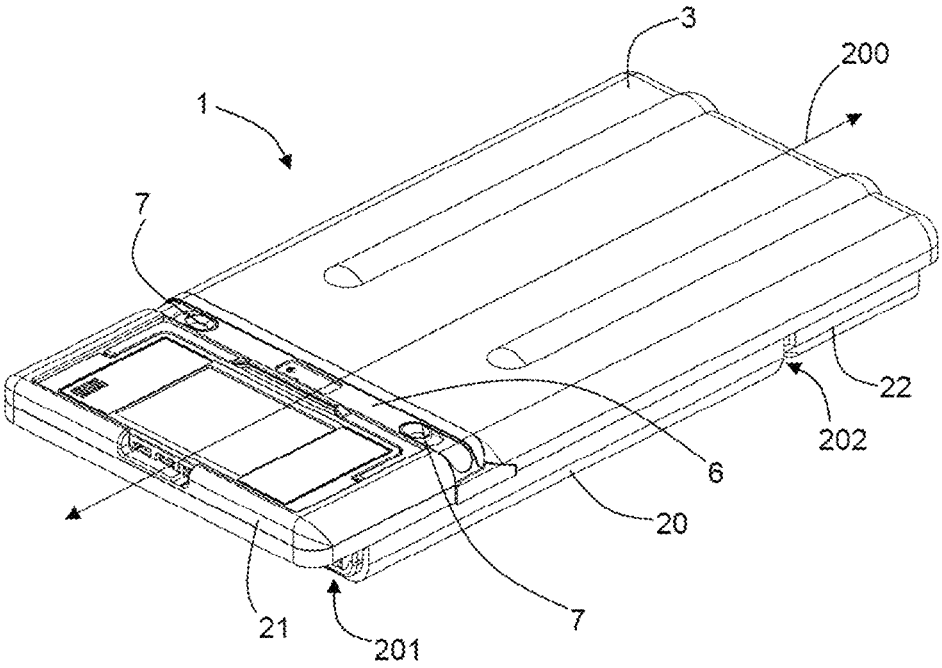
FIG. 2 is a schematic perspective top representation of the package according to the invention, in a flat configuration.
Figure 3:
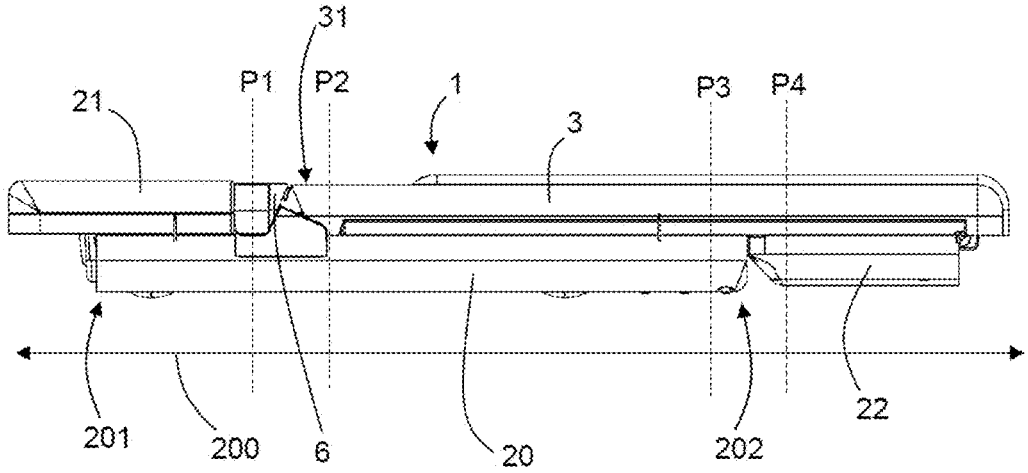
FIG. 3 is a schematic representation in side view of the package according to the invention, in the flat configuration.

In its flat configuration illustrated in FIGS. 2 and 3, the front panel 21, the rear panel 22, and the side panels 23 extend substantially parallel to the bottom 20. The front panel 21, the rear panel 22, and the side panels 23 are then each in a folded down position (or "stowed position").

Indeed, in this flat configuration of the package 1, the side panels 23 are folded down, directly, against the bottom 20.

Then, one of the front panel 21 and of the rear panel 23 is folded down against the bottom 20 by overlapping the side panels 23, and the other of the front panel 21 and of the rear panel 22 is folded down backward, that is to say pivoted backward and positioned in the extension of the bottom 20.

In this case, the front panel 21 is in a position folded down against the bottom 20 by overlapping the side panels 23, and the rear panel 22 is pivoted rearward, in the extension of the bottom 20. The rear panel 22 is then located in the same plane as the bottom 20.

Finally, the lid 3 is also folded down against the bottom 20. The lid 3 then covers the side panels 23. According to the present embodiment, the lid 3 also covers the rear panel 22.

As mentioned above, the lid 3 is pivotally mounted on the rear panel 22.

Referring to FIGS. 2 and 3, the package 1 comprises a member for holding 6 by overlapping one of the front panel 21 and of the lid 3.

In this case, to maintain a front edge 31 of the lid 3 in its position folded down against the bottom 20, the front panel 21, as illustrated in FIGS. 1 to 5, comprises the overlapping holding member 6, thus intended to make an overlapping of the lid 3 in the flat configuration of the package 1.

In the flat configuration of the package 1, illustrated in FIG. 2 and in FIG. 3, the holding member 6 blocks the lid 3 in its position folded down against the bottom 20. This holding member 6 takes the form of a cap extending by overlapping that is to say above the front edge 31 of the lid 3.

Of course, according to this embodiment, the lid 3 must be completely folded down against the bottom 20 before the front panel 21 is in turn completely folded down.

According to one embodiment not represented, another type of overlapping holding member 6 can take the form of at least one arm movably mounted on one of the front panel 21 and of the lid 3. In this case, the arm is positioned under the other of the front panel 21 and of the lid 3 in the flat configuration of the package 1. The front panel 21 or the lid 3 carrying the arm cannot then be raised without the other of the front panel 21 or of the lid 3 has been raised beforehand, because the arm(s) is/are captive under this element.

According to the principle of the invention, the package 1 comprises, in its flat configuration, anchors between the bottom 20 and at least one of the panels 21, 22, 23, 3 in its position folded down against the bottom 20.

Each anchor is designed to exert a force for holding such a panel 21, 22, 23, 3 in its position folded down against the bottom 20.

In particular, this holding force appears as soon as a force tends to move apart said panel 21, 22, 23, 3 from its position folded down against the bottom 20.

These anchors are composed of at least a first anchor 41, 42 located in the vicinity of the front end 201 of the bottom 20, and at least a second anchor 51, 52 located in the vicinity of the rear end 202 of the bottom 20.

The first anchors 41, 42 are spaced from the second anchors 51, 52 along the first axis 200.

In other words, the first anchors 41, 42 are not directly adjoined to the second anchors 51, 52.

According to the present embodiment, the anchors comprise:

- two first anchors 41, 42, including a first left anchor 41 and a first right anchor 42, which are respectively located in the vicinity of each side end 203 of the bottom 20, at the same length along the first axis 200;
- two second anchors 51, 52, including a second left anchor 51 and a second right anchor 52, distributed respectively in the vicinity of each side end 203 of the bottom 20, at the same length from the first axis 200.

Referring to FIG. 3, in a non-limiting manner, four possible anchor positions are represented, including:

- a first position P1 and a second position P2 located in the vicinity of the front end 201 of the bottom 20, and
- a third position P3 as well as a fourth position P4 located in the vicinity of the rear end 202 of the bottom 20.

In other words, the first two anchors 41, 42 can be located at a position along the first axis 200 corresponding to the position P1 or to the second position P2, while the two second anchors 51, 52 can be located at a position along the first axis 200 corresponding to the third position P3 or to the fourth position P4.

As described below, each anchor comprises two parts, including a first part presented by a first element of the package 1, and a second part presented by a second element of the package 1. The first part and the second part of each anchor are complementary to each other to achieve the anchor when the package 1 is in its flat configuration.

Figure 4:
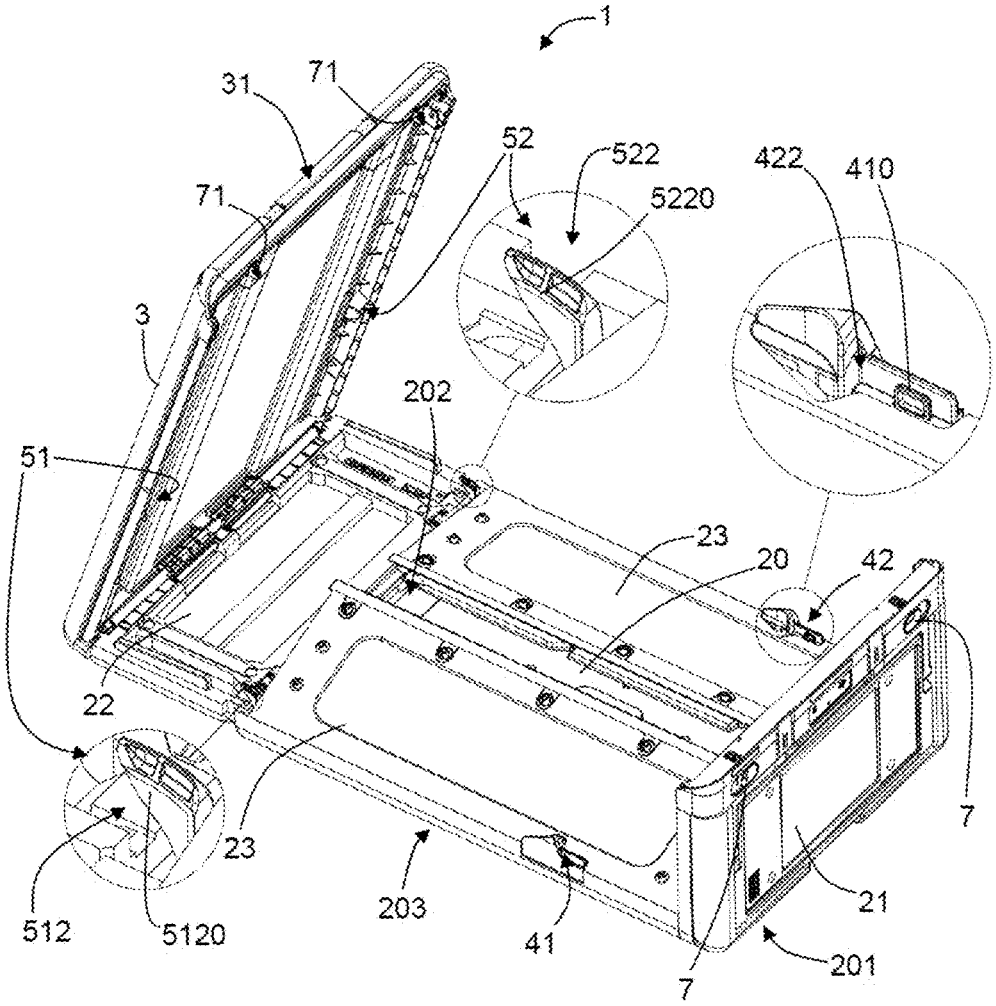
FIG. 4 is a schematic perspective top representation of the package according to the invention, in an intermediate state between the use configuration and the flat configuration, with a detail medallion illustrating part of an anchor presented by a bottom of the package.
Figure 5:
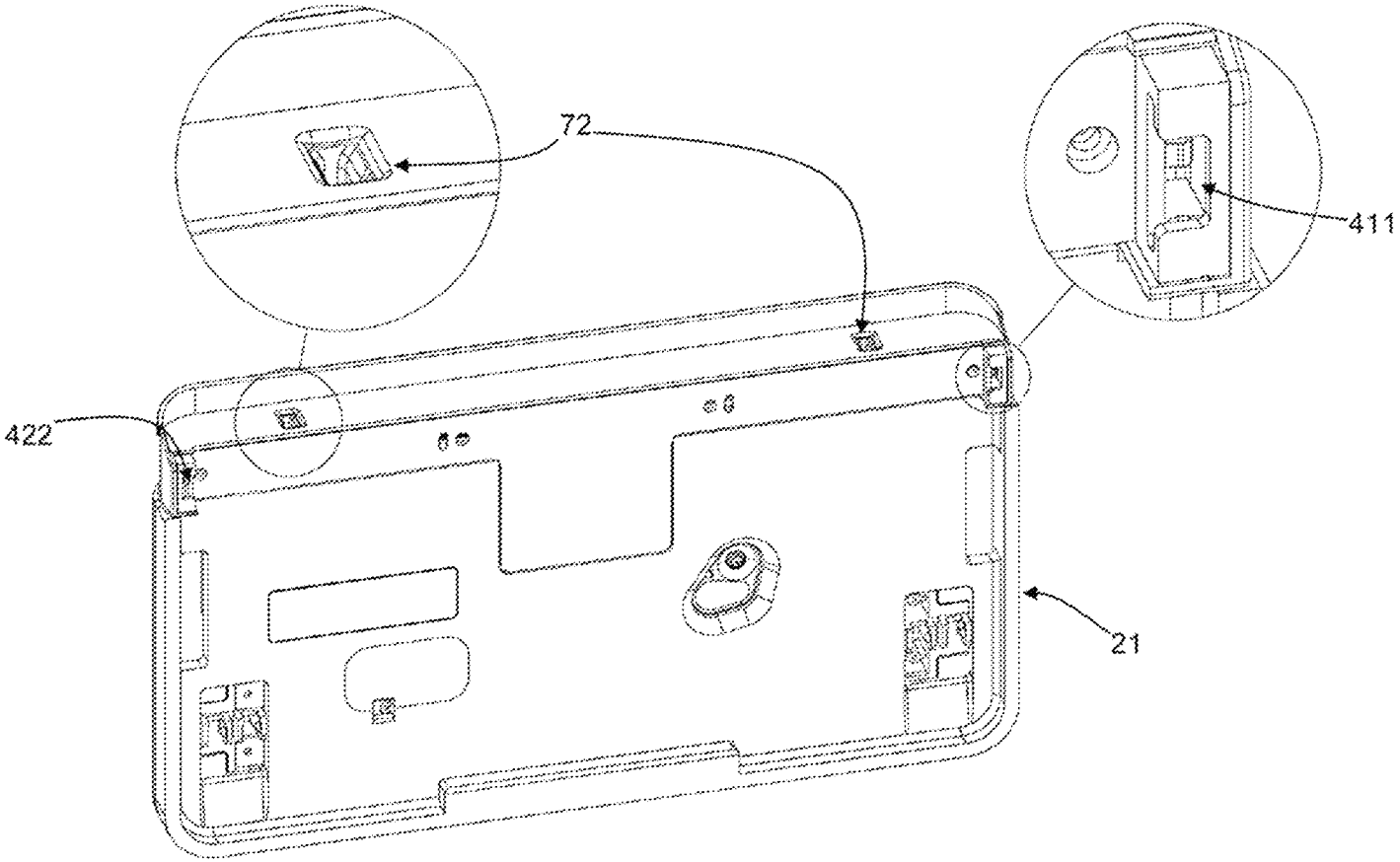
FIG. 5 is a schematic perspective top representation of a rear face of a front panel of the case of the package, the panel integrating a locking mechanism, comprising two detail medallions illustrating parts of anchor points.
Figure 6:
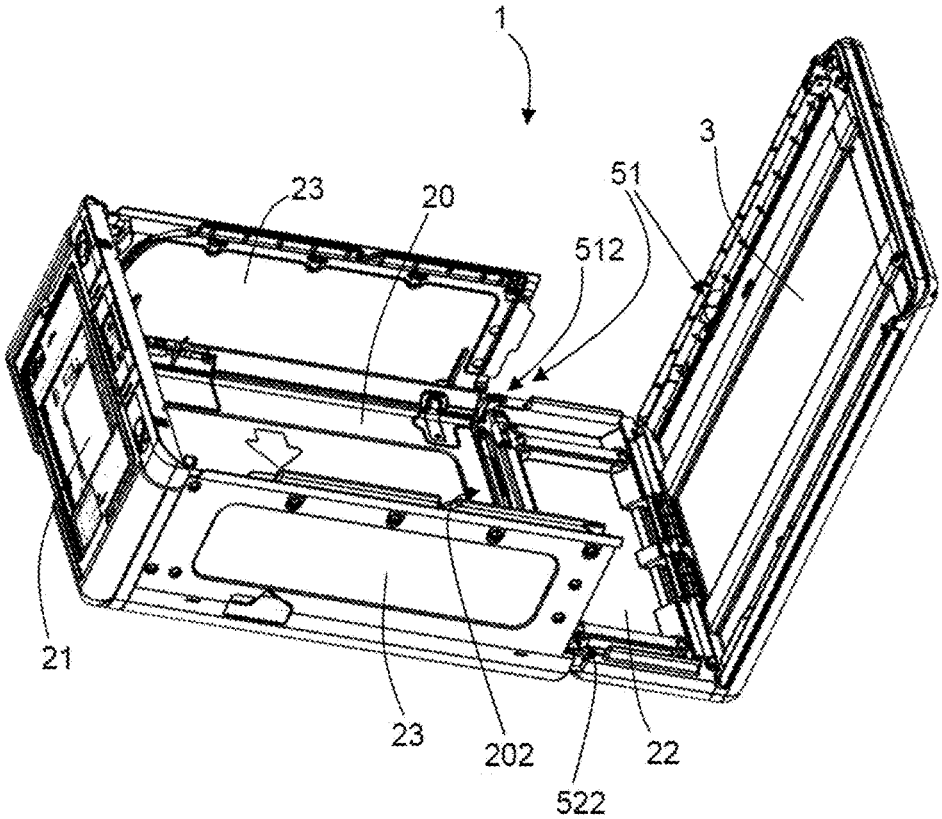
FIG. 6 is a schematic representation in top view of the package according to the invention, in an intermediate state between the use configuration and the flat configuration.
Figure 7:
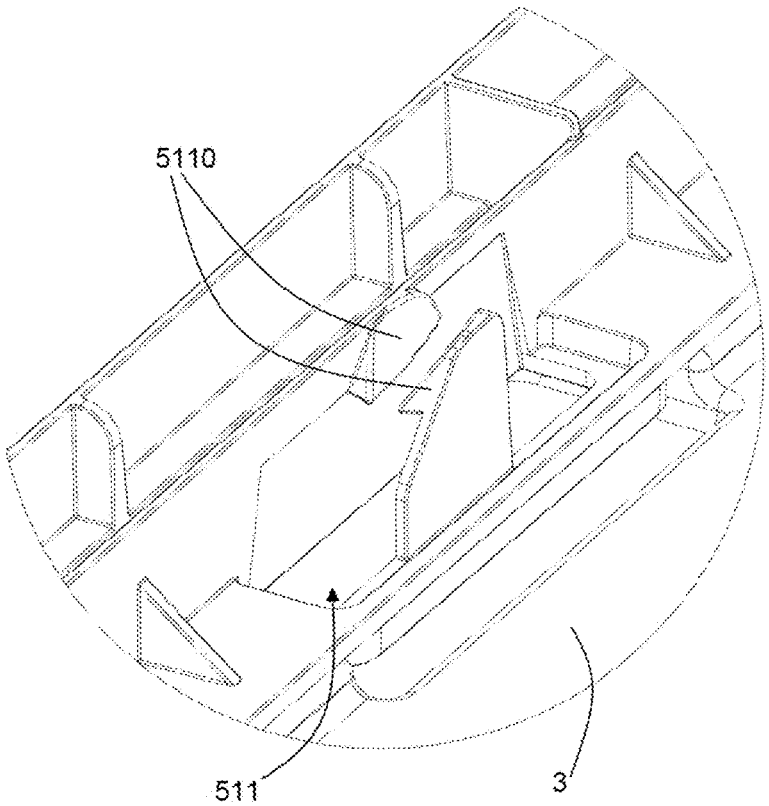
FIG. 7 is a schematic perspective representation, centered on part of a second anchor presented by the lid of the package.
Figure 8:
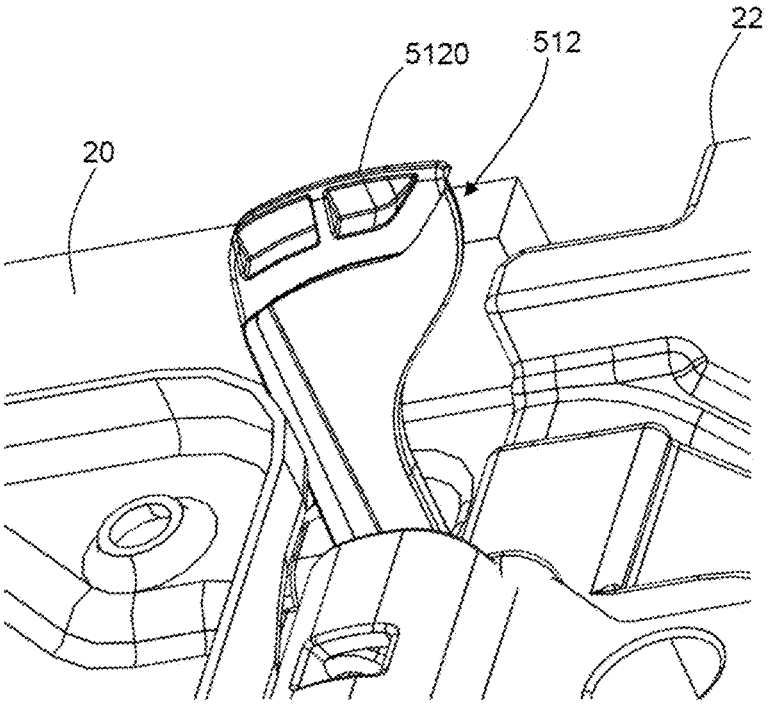
FIG. 8 is a schematic perspective top representation of another part of an anchor carried by the bottom of the package, complementary to the part of the anchor illustrated in FIG. 7.
Figure 9:
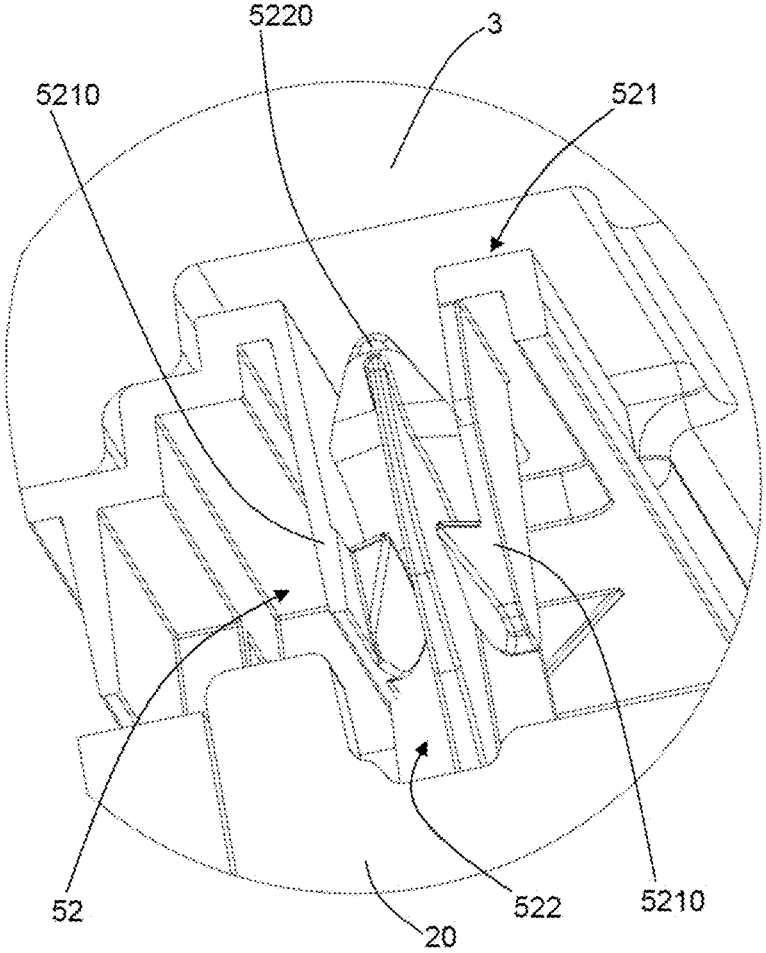
FIG. 9 is a schematic sectional representation of the cooperation of the two anchor parts illustrated in FIGS. 7 and 8.

According to the present embodiment, the first anchors 41, 42 comprise a first part presented by the front panel 21, as illustrated in FIG. 5 and a second part presented by the bottom 20, as illustrated by FIG. 4.

Consequently, when the front panel 21 is folded down against the bottom 20, then the first anchors 41, 42 are operative and exert a force for holding the front panel 21 in its position folded down against the bottom 20.

Referring to FIG. 4, the second part 412 of the first left anchor 41 and the second part 422 of the first right anchor 42 are formed by anchor points 410 retracted into the side panels 23 in the use configuration of the package 1 and being visible when the side panels 23 are folded down against the bottom 20.

Referring to FIG. 5, the anchor points 410, formed by rings, are complementary to the first part 411 of the first left anchor point 41 and to the first part 421 of the first right anchor point 42 presented by the front panel 21.

When the front panel 21 is folded down against the bottom 20, then the anchor points 410 of the second parts 412, 422 fit inside the first parts 411, 421. The anchors are thus operational.

These first anchors 41, 42 are of the type operable by clipping.

That is to say a switching of the package 1 into its flat configuration, from its use configuration, makes it possible to cause the clipping of these anchors.

Such clipping is for example achievable by means of a movable hook between a hooked position of the anchor point 410 and a released position.

This hook can comprise an elastic return system tending to maintain it in its hooked position, combined with a design, for example an outer bevel, causing the switching of the hook from its locked position to its released position during the insertion of the anchor point 410 inside the first parts 411, 421, and a return of the hook to its hooked position as soon as the insertion is complete. The outer bevel can in particular form a cam system causing the withdrawal of the hook during the insertion of the anchor point 410, this anchor point pressing on the bevel and then causing it to move back.

According to the present embodiment and with reference to FIGS. 1, 2, and 4, the package 1 comprises a locking mechanism including two actuators 7.

These actuators 7 are movable between:

- a locked position, in particular represented in FIGS. 1 and 2, in which, in the flat configuration of the package 1, the first anchors 41, 42 are locked;
- an unlocked position in which the first anchors 41, 42 are unlocked.

The first anchors 41, 42 are then anchors called "lockable anchors".

This locking mechanism comprises means for elastically returning the actuators 7 tending to bring them back from their unlocked position to their locked position. These elastic return means can advantageously be the same as the means for returning the hooks mentioned above.

According to the present embodiment, the locking mechanism is also designed to make it possible to lock the lid 3 when it seals the stowage volume of the package 1 in the use configuration.

To this end, and with reference to FIGS. 4 and 5, the lid 3 has two locking members 71 and the front panel 21 has two locking elements 72, complementary to the two locking members 71.

In this case, when the package 1 is in its use configuration and when the lid 3 closes the stowage volume, then:

- in the locked position of the actuators 7, the two locking members 71 are inserted and held captive in the two locking elements 72; and in the unlocked position of the actuators 7, the two locking members 71 are inserted into the two locking elements 72 but are not held captive, the lid 3 can be freely pivoted backward.

To allow the change of locking state during the actuation of the actuators 7, the locking mechanism can implement a rod or cam system, of conventional design known per se.

Referring to FIGS. 6 to 9, the second anchors 51, 52 are described below.

As mentioned previously, these second anchors 51, 52 are located in the vicinity of the rear end 202 of the bottom 20.

According to the present embodiment, the second anchors 51, 52 are composed of a second left anchor 51 and of a second right anchor 52. These anchors are in particular located at the length corresponding to the position P3 illustrated in FIG. 3.

According to the present embodiment, the second anchors are made between the bottom 20 and the lid 3.

The second anchors 51, 52 are also of the type operable by clipping. That is to say, when the package 1 has switched into its flat configuration, then the clipping of the second anchors 51, 52 is carried out.

Unlike the first anchors 41, 42, the second anchors 51, 52 are not lockable anchors.

As mentioned above, the second anchors 51, 52 comprise a first part 511, 521 and a second part 512, 522.

In particular, the second anchors 51, 52 comprise:

a first part 511, 521 formed by receptacles with hooks presented by the lid 3;

a second part 512, 522 carried by the bottom 20 in the immediate vicinity of the rear end 202 of the bottom 20.

These second parts 512, 522 are formed by complementary hooks 5120, 5220 by snapping of the receptacles with hooks, formed by the first parts 511, 521 of the second anchors 51, 52.

The receptacles with hooks, forming the first parts 511, 521 of the second anchors 51, 52 comprise in particular at least two partially elastically deformable wings 5110, 5210. These wings 5110, 5210 make it possible to guide the hooks 5120, 5220 when the package 1 is switched into its flat configuration and in particular during the snapping of these hooks 5120, 5220 between the wings 5110, 5210 of the receptacles with hooks.

Referring to FIGS. 7 to 10, the hooks 5120, 5220 and the receptacles with hooks have a shape designed to detach the second anchors 51, 52 when a user wishes to unfold the package 1 from its flat configuration.

In particular, the hooks 5120, 5220 have a rounded shape pointing away from the front end of the bottom 20, in the direction of a position towards which the lid 3 must be raised when the package 1 must be unfolded from its flat configuration. The receptacles with hooks are open in the direction of the front end of the bottom 20.

Figure 10:
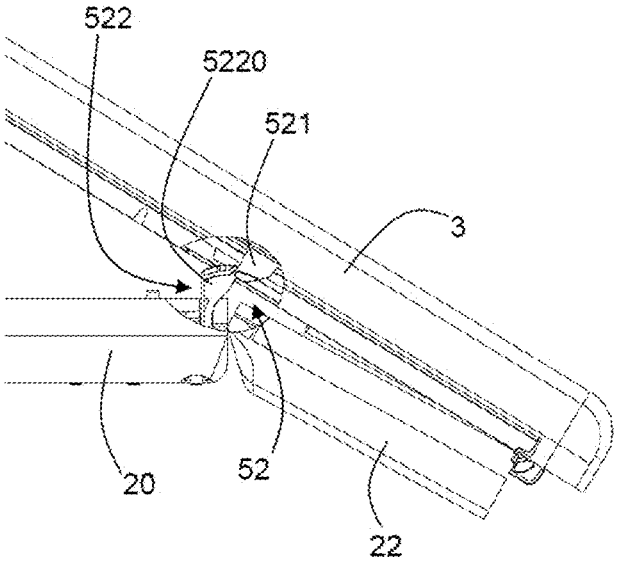
FIG. 10 is a partial schematic representation in side view of a detached position of the anchors of FIGS. 7 to 9.

Also, and more specifically with reference to FIG. 10, rearward pivoting of the rear panel 22, beyond its folded down position in the extension of the bottom, makes it possible to disengage the hooks 5120, 5220 from the receptacles with hooks.

FIG. 10 thus illustrates an intermediate configuration between the flat configuration and the use configuration, for detaching the second anchors 51, 52.

According to another possible design, the second anchors 51, 52 are anchors that can be "unclipped by force" or in other words "unclasped by force". That is to say, to make the second anchors 51, 52 inoperative, it is necessary to exert a pull of a force greater than the force of the holding in the folded down position exerted by the second anchors 51, 52.

The invention claimed is:

1. A package comprising a bottom extending between a front end and a rear end along a first axis, the package also comprising panels including:

a front panel pivotally mounted on the front end of the bottom;

a rear panel pivotally mounted on the rear end of the bottom;

side panels pivotally mounted on the bottom;

a lid pivotally mounted on one of the front panel or of the rear panel;

the package being foldable between:

a use configuration in which the bottom, the front panel, the rear panel and the side panels form a case defining a stowage volume, and in which the lid is capable of sealing the stowage volume;

a flat configuration, in which the panels extend substantially parallel to the bottom;

wherein in the flat configuration of the package:

the side panels are in a position folded down against the bottom;

one of the front panel and of the rear panel is in a position folded down against the side panels overlapping the bottom, and the other of the front panel and of the rear panel is in a pivoted position in line with of the bottom;

the lid is in a position folded down substantially parallel to the bottom, overlapping the side panels;

wherein the package comprises anchors between the bottom and at least one of the panels in a position folded down against the bottom, each anchor exerting, in the flat configuration of the package, a force for holding said at least one of the panels in its position folded down against the bottom, the anchors comprising:

at least a first anchor in the vicinity of the front end of the bottom;

at least a second anchor in the vicinity of the rear end of the bottom;

the first anchor(s) being spaced from the second anchor(s) along the first axis.

2. The package according to claim 1, wherein the bottom comprises two side ends on which the side panels are pivotally mounted, and in that the anchors comprise:

two first anchors distributed respectively in the vicinity of each side end of the bottom, at the same length along the first axis;

two second anchors distributed respectively in the vicinity of each side end of the bottom, at the same length along the first axis.

3. The package according to claim 1, wherein the lid is pivotally mounted on the rear panel, one of the lid or of the front panel having:

a first part of the or each first anchor, the bottom having a second part of the or each first anchor complementary to the first parts;

a member for holding by overlapping the other of the lid or of the front panel;

and in that, in the flat configuration of the package, the holding member maintains said other of the lid or of the front panel in its position folded down against the bottom.

4. The package according to claim 1, wherein the first anchor(s) and/or the second anchor(s) are of the type operable by clipping, a switching of the package into its flat configuration being likely to cause the clipping of said anchors.

5. The package according to claim 4, wherein the package comprises a locking mechanism including at least one movable actuator between:

a locked position in which, in the flat configuration of the package, the first anchor(s), and/or the second anchor(s), called lockable anchors, are locked, and an unlocked position in which the lockable anchor(s) are inoperative.

6. The package according to claim 5, wherein the locking mechanism comprises means for elastically returning the actuator(s) tending to bring them back from their unlocked position to their locked position.

7. The package according to claim 5, wherein only some of the first anchors or of the second anchors are lockable anchors, the others of the first anchors or of the second anchors can be unclipped by force.

8. The package according to claim 5, wherein only some of the first anchors or of the second anchors are lockable anchors, the others of the first anchors or of the second anchors being detachable by means of a pivoting of the panel located in a position folded down in the extension of the bottom beyond this position folded down in extension of the bottom.

* * * * *